US005135244A

United States Patent [19]

Allison

[11] Patent Number: 5,135,244

[45] Date of Patent: Aug. 4, 1992

[54] SUSPENSION AND BRAKING SYSTEM FOR A TANDEM WHEELED SKATE

[75] Inventor: William D. Allison, Grosse Pointe Farms, Mich.

[73] Assignee: WDRM Patent Co., Grosse Pointe Farms, Mich.

[21] Appl. No.: 689,390

[22] Filed: Apr. 22, 1991

[51] Int. Cl.[5] ..... A63C 1/28; A63C 17/06

[52] U.S. Cl. ..... 280/11.28; 280/11.2; 280/11.22

[58] Field of Search ..... 280/11.2, 11.22, 11.23, 280/11.27, 11.28, 87.03, 87.042, 7.13, 7.14

[56] References Cited

U.S. PATENT DOCUMENTS

| | | | |
|---|---|---|---|
| 2,566,747 | 9/1951 | Rice | 280/11.2 |
| 2,725,238 | 11/1955 | Day | 280/11.2 |
| 3,339,936 | 9/1967 | Hamlin | 280/11.2 |
| 3,900,203 | 8/1975 | Kukulowicz | 280/11.22 X |
| 4,062,557 | 12/1977 | Roden | 280/87.042 |
| 4,272,090 | 6/1981 | Wheat | 280/11.28 X |

FOREIGN PATENT DOCUMENTS

| | | | |
|---|---|---|---|
| 167622 | 2/1901 | Fed. Rep. of Germany | 280/11.2 |
| 217412 | 12/1909 | Fed. Rep. of Germany | 280/11.22 |
| 2308173 | 8/1974 | Fed. Rep. of Germany | 280/11.22 |
| 834131 | 5/1960 | United Kingdom | 280/11.28 |
| 837828 | 6/1960 | United Kingdom | 280/11.28 |
| 2160780 | 1/1986 | United Kingdom | 280/11.2 |

*Primary Examiner*—Andres Kashnikow
*Assistant Examiner*—Brian L. Johnson
*Attorney, Agent, or Firm*—Gifford, Groh, Sprinkle, Patmore & Anderson

[57] ABSTRACT

A tandem roller skate employing a suspension system by which the tandem positioned wheels are articulated relative to each other through a truck and beam arrangement to absorb loads imposed on any one wheel and transmit the load to the other of the wheels. A braking arrangement is formed by a leaf spring positioned to selectively engage either a forward or rearward wheel of the skate to exert a variable frictional load impeding rotational movement.

12 Claims, 2 Drawing Sheets

SUSPENSION AND BRAKING SYSTEM FOR A TANDEM WHEELED SKATE

BACKGROUND OF THE INVENTION

1. Field of the Invention

This invention relates to roller skates having their wheels supported in tandem and more particularly to a suspension and braking system for such skates.

2. Description of the Related Art

A variety of tandem wheeled roller skates have been provided in which the load imposed on any one wheel is transmitted directly and vertically upwardly to the foot of the skater in the area of where the load is imposed. In one prior art arrangement an effort is made to resiliently suspend the wheels, each separately, by employing a pair of springs for each wheel. This makes for a complex arrangement that requires continuous maintenance of the springs and furthermore makes each wheel absorb loads independently.

SUMMARY

The purpose of the present invention is to instantly distribute the load imposed on any one of the tandem mounted wheels to the remaining wheels thereby distributing the load to the foot of the skater in a manner such that the load is transmitted through a single spring such means that serves to absorb the load and distribute it to the foot of the skater independently of the location of the load imposed on the skate.

The object of the invention is obtained by a tandem, in-line roller skate having a plurality of wheels supported for rotation in a common plane by a beam pivoted for limited tilting movement about a transverse axis on the bottom side of a platform that supports the foot of the skater, with the beam supporting a pair of sub-frames or trucks at its opposite ends pivoted about transverse axes with each truck supporting a pair of tandem wheels also rotating about transverse axes. The vertical movement of the wheels, and pivotal movement of the trucks and beam are absorbed by a single spring means in the form of a resilient bushing.

DESCRIPTION OF A PREFERRED EMBODIMENT

Figure 2:
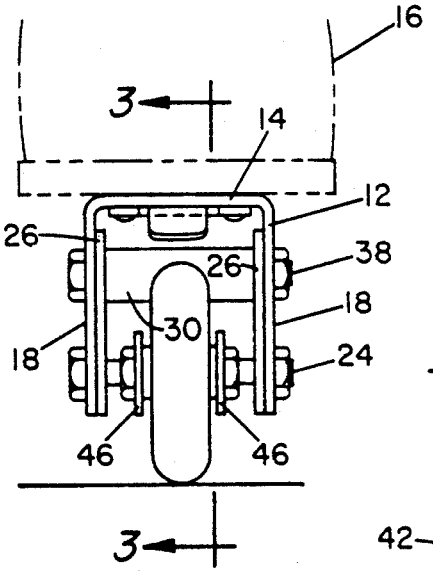
FIG. 2 is an enlarged front view of the roller skate as seen in FIG. 1 along line 2—2.

The roller skate 10 embodying the present invention includes a main frame 12 which is generally channel-shaped and has an upper flat support platform portion or base 14 extending generally longitudinally at the bottom of the shoe 16 of the skater. A pair of parallel flanges 18 depend from opposite sides of the flat support portion 14.

A beam assembly 20 is pivoted to the base 12 for relative tilting movement. For this purpose, a pair of aligned openings 22 in a lower portion of flanges 18 receive an axle in the form of a bolt 24 (seen in FIG. 2) extending transversely of base 14.

Figure 5:
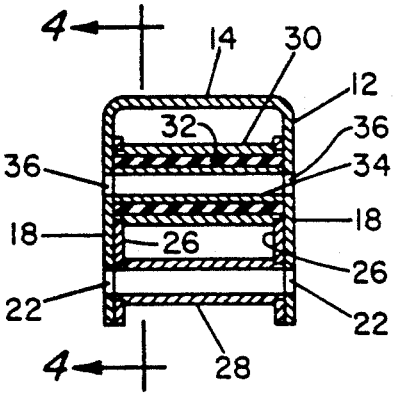
FIG. 5 is a cross-sectional view taken on line 5—5 in FIG. 4.

The beam assembly 20 includes a pair of laterally spaced, elongated frame members 26 rigidly connected together by a tubular bearing 28 seen in FIG. 5. Bearing 28 receives the bolt 24. A second slightly larger tube 30 is positioned above tube 28. The tubes 28 and 30 are rigidly connected to the frame members 26 to form a rigid, unitary structure which is disposed between flanges 18 of base 12.

Figure 4:
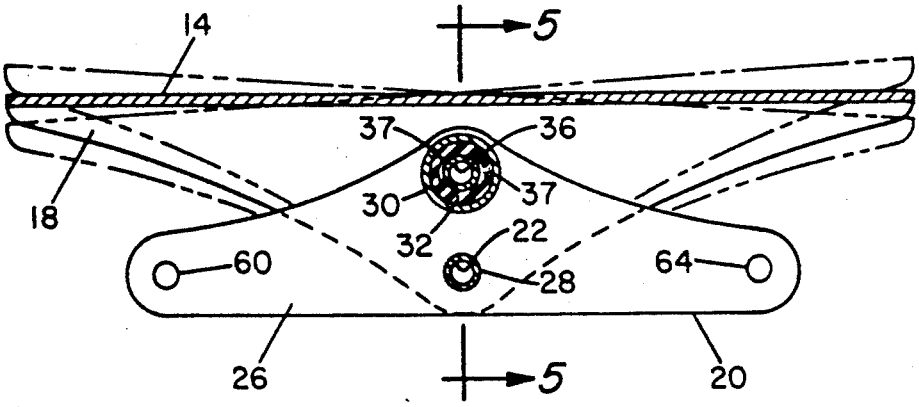
FIG. 4 is a cross-sectional view at an enlarged scale taken on line 4—4 in FIG. 5 showing components of the roller skate seen in FIG. 1.
Figure 6:
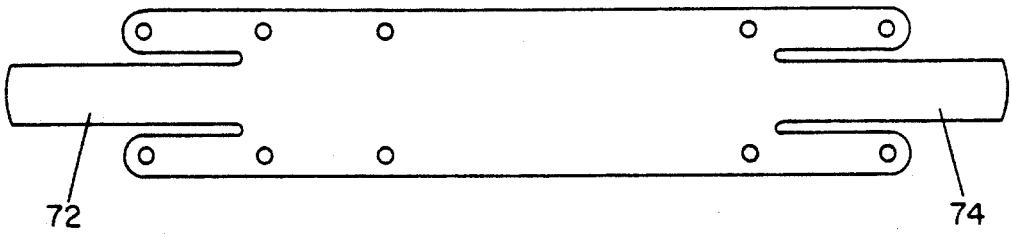
FIG. 6 is a plan view of a brake element employed in the roller skate embodying the invention.
Figure 7:
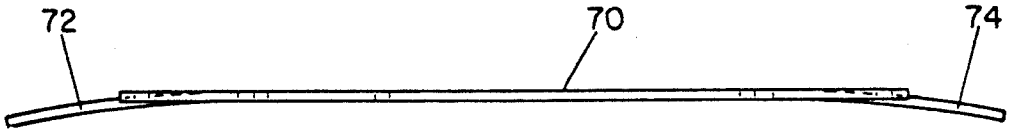
FIG. 7 is a side elevation of the brake element as seen in FIG. 6.

As seen in FIG. 5, the tube 30 houses an elastomeric bushing 32 which has a generally tubular configuration. The bushing 32 has a metal tubular element of 34 on its inner diameter which is axially aligned with openings 36 in the flanges 18 of the base 12. The aligned openings 36 and tube 34 receive bolt 38 (FIG. 2) which is parallel to bolt 24. The bolts 24 and 38 are stationary relative to the base 12, but the bushing 32 allows limited tilting movement of the base 12 and beam assembly 20 relative to each other as illustrated by the broken lines in FIG. 4. This serves as a spring means in which bolt 38 supported in opening 36 deflects the forward and rearward walls of the bushing during tilting of frame 12 and beam 20 as illustrated at 37 in FIG. 4.

The longitudinally extending beam assembly 20 supports a pair of sub-frames or truck assemblies 40 and 41. The forward truck assembly 40 also supports a pair of tandem wheels 42 and 43 and the rearward truck assembly 41 supports a pair of tandem wheels 44 and 45.

Figure 8:
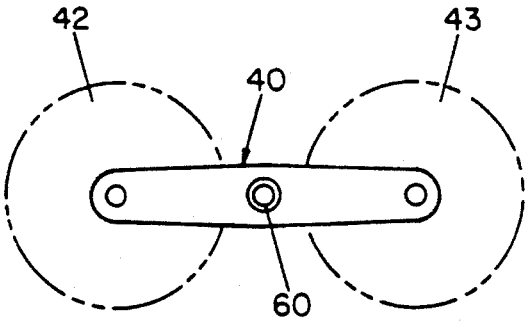
FIG. 8 is a side elevation of one of the truck elements in the roller skate illustrated in FIGS. 1 and 2.
Figure 9:
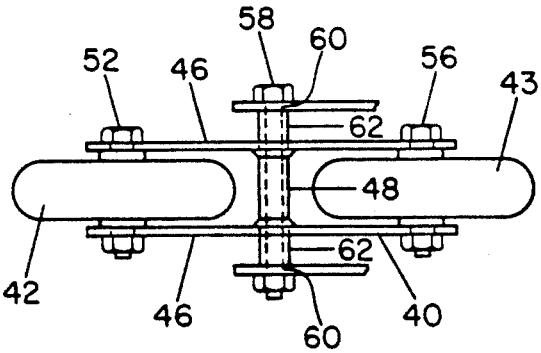
FIG. 9 is a plan view of the truck element seen in FIG. 8 with additional associated components of the skate seen in FIG. 1.

As best seen in FIGS. 8 and 9, the truck 40 includes a pair of side rails 46 which are joined together at a midpoint by a tubular member 48 to form a rigid and generally H-shaped configuration as viewed in FIG. 9. The side rails 46 are provided with a pair of aligned forward openings 50 which receive a bolt 52 forming the axle for the forward wheels 42. Similarly, a pair of rearward openings 54 are adapted to receive a bolt 56 forming the axle for rear wheels 43.

The side rails 46 and the tubular member 48 form a rigid truck frame supporting the wheels 42, 43 rotating about axles passing through aligned pairs of openings 50 and 54, respectively. The forward truck 40 is supported by means of a bolt 58 as seen in FIG. 9 passing through aligned openings 60 at the forward end of the beam assembly 20. The bolt 58 also passes through spacers 62 at opposite sides of the truck 40 to maintain the truck centered between the flanges 18 of the beam assembly 20.

Figure 3:
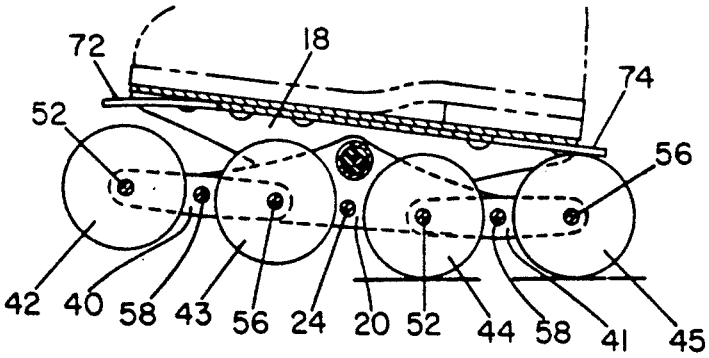
FIG. 3 is a cross-sectional view taken on line 3—3 in FIG. 2 showing an operating condition of the roller skate.

The rear truck 41 is identical to truck 40 and supports a pair of wheels 44 and 45 on axles 52′ and 56′ (FIG. 3). The truck 41 is mounted in a similar manner as the forward truck 40 by another bolt 58′ (FIG. 3) passing through aligned openings 64 (FIG. 4) at the rearward end of the beam assembly 20.

The trucks 40 and 41 are free to tilt relative to the beam assembly 20 and the beam assembly 20 is supported for tilting movement relative to the frame 12. As best seen in FIG. 3 the various axles 52, 56 and 52', 56' and pivot axes 58, 58' and 24 form means for receiving pivot bolts or axles which are spaced substantially uniformly apart. This serves to form seven spaced, transverse axes beginning with axle 52 followed by pivot bolt 58 for forward truck 40, axle 56 for wheel 43, bolt 24 forming the pivot for beam 20, axle 52' for wheel 44, pivot bolt 58' for rear truck 41 and axle 56' for the rear wheel 45.

Figure 10:
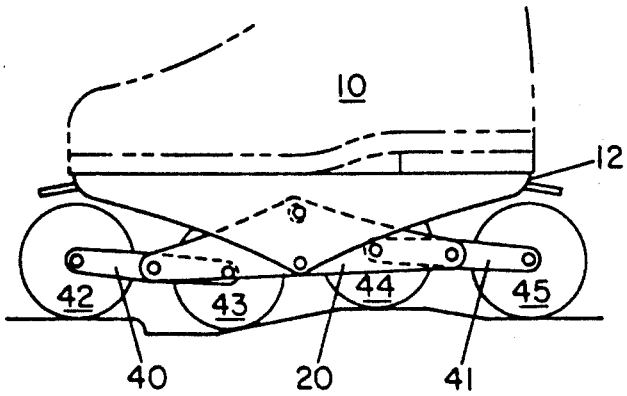
FIG. 10 is a side elevation of the roller skate seen in FIG. 1 but with the skate on uneven terrain.

As best visualized by viewing FIG. 10, during movement of the roller skate 10 over an irregular surface, any load imposed on any one of the wheels is transmitted through its associated truck 40 or 41 to the other wheel also supported by that same truck. The load also is transmitted from the truck 40 or 41 first receiving the load to the other truck through the beam assembly 20 pivoting about the axis of bolt 24. By way of example, if a load is first encountered by the forward wheel 42, the load is distributed through the truck 40 about the axis of bolt 58 to the wheel 43 at the rear of the forward truck 40. At the same time, the load is distributed from truck 40 to the beam assembly 20 to the rear truck 41 and to its associated pair of wheels 44 and 45. In this manner any load imposed on any one of the wheels is shared by the remaining wheels through a linkage arrangement formed by the trucks 40, 41 and the beam assembly 20. The load on the beam assembly 20 is absorbed by the bushing 32 which acts as a spring to resiliently absorb the loads transmitted between the wheels and the frame 12. The durameter hardness of the rubber of bushing 32 can be selected to provide the desired spring rate.

Figure 1:
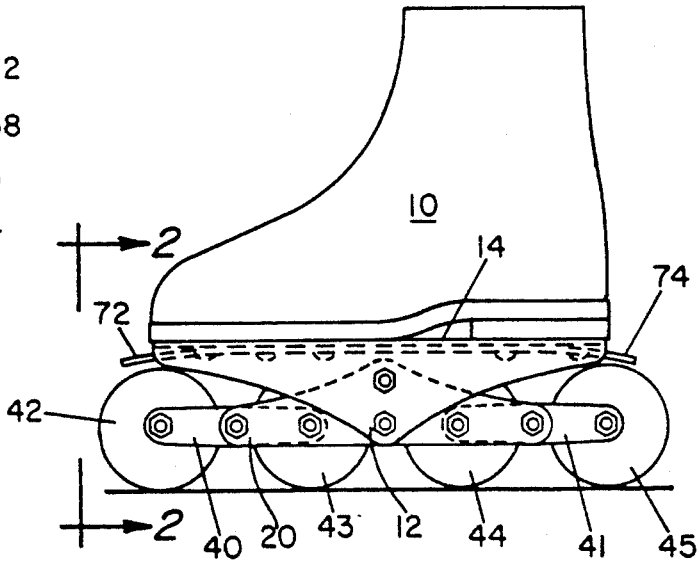
FIG. 1 is a side elevation of a roller skate embodying the present invention.

The braking arrangement for the skate is provided by an elongated leaf spring 70 which may be riveted to the base 12 at the underside of the flat support portion 14 and between the flanges 18 as best seen in FIG. 2. Opposite ends of the spring members 70 are provided with projections 72 and 74. As seen in FIGS. 1 and 3, projections 72 and 74 are positioned in spaced relationship to the surface of the forward wheel 42 of the forward truck 40 and the rearward wheel 45 of the rearward truck 41. Application of the brakes is achieved by tilting the foot or shoe 16 as best seen in FIG. 3 to lift the toe and bring the rearward projection 74 into frictional engagement with the rearwardmost wheel 45 of the skate 10. This will provide a braking action for retarding the forward movement of the skater. Similarly, lifting of the heel of the shoe 16 will bring the projection 72 into engagement with the forward wheel 42 of the skate to retard rotational movement. The degree of tilting will determine the degree of braking.

I claim:

1. An in-line roller skate comprising:

a plurality of wheels supported for rotation in a common plane, a support platform having an upper and lower side for supporting the foot of a user on the upper side, a beam pivoted for limited tilting movement about a transverse axis at the lower side of said platform, means spaced from said axis for resiliently resisting tilting movement of said beam about said axis and including a tubular member of elastomeric material supported on an element extending transversely of said beam in parallel relationship to said transverse axis, a pair of trucks each including at least a pair of tandem wheels supported for rotation about transverse axes, one of said trucks being pivoted to a forward end of said beam and the other of said trucks being pivoted to the rearward end of said beam for tilting movement about transverse axis relative to said beam, said wheels of said pair of trucks being disposed for rotation in a common plane.

2. The roller skate of claim 1 wherein said transverse axis supporting said beam relative to the bottom side of said platform is disposed at a point midway between said transverse axes supporting said pair of trucks.

3. A tandem roller skate comprising:

a support platform, a longitudinally extending beam having an intermediate portion pivoted to an underside of said platform for tilting movement about a first transverse axis, means resiliently resisting said tilting movement including an elastomeric element supported on a transverse member spaced from said first transverse axis, a first truck member including a pair of wheels supported in tandem, a second truck member including a pair of wheels supported in tandem, said first truck member being pivoted to a forward end of said beam for tilting movement about a second transverse axis disposed between the wheels of said first truck member, a second truck member pivoted to the rearward end of said beam for tilting movement about a third transverse axis disposed between the wheels of said second truck member, said wheels, truck members and beam being disposed substantially in a common plane whereby upward movement of any one wheel is distributed to the other wheel associated with the same truck member and from that truck member through said beam to the other of said truck members for uniform distribution of the load imposed on said platform.

4. The roller skate of claim 3 wherein said elastomeric element is confined within a tubular member forming a unitary portion of said beam.

5. A roller skate comprising:

a frame for supporting a skater's shoe, a longitudinally extending beam assembly pivoted to said frame for limited tilting movement about a first transverse axis, means resiliently resisting said tilting movement including a generally tubular resilient member spaced from said first axis and mounted on an element extending transversely of said beam, a first sub-frame having an intermediate portion pivoted to a forward end of said beam for tilting movement about a second transverse axis, a second sub-frame having an intermediate portion pivoted to a rearward end of said beam for tilting movement about a third transverse axis.

a pair of wheels supported at opposite ends of said first sub-frame for rotation about fourth and fifth axes, respectively, a pair of wheels supported at opposite ends of said second subframe for rotation about a sixth and seventh axes, respectively, all of said axes being disposed substantially parallel to each other and all of said wheels being rotatable in a common plane.

6. The combination of claim 5 wherein said first, second and third axes are spaced substantially uniformly from each other.

7. The combination of claim 5 wherein said first through said seventh axes are spaced substantially uniformly relative to each other.

8. The combination of claim 5 wherein said first through said seventh axes are disposed in a substantially horizontal plane when said wheels are disposed on a level surface.

9. The combination of claim 5 wherein said resilient member is confined within a tubular member extending transversely of said beam and rigidly connected to said beam.

10. The combination of claim 5 further comprising a brake member attached to said frame and including a portion engageable with one of said wheels for frictionally resisting rotation thereof in response to tilting movement of said frame relative to said beam assembly.

11. The combination of claim 10 wherein said brake member is engageable with a rear wheel of said skate upon elevation of a forward end of said frame.

12. The combination of claim 10 wherein said brake member is engageable with a forward wheel of said skate upon elevation of the heel of said skater.

* * * * *